United States Patent [19]

Baucum

[11] Patent Number: 4,491,440

[45] Date of Patent: Jan. 1, 1985

[54] METHOD AND APPARATUS FOR INSTALLING A ROOF SUPPORT MEMBER IN A MINE

[75] Inventor: Dewayne E. Baucum, Price, Utah

[73] Assignee: Atlantic Richfield Company, Los Angeles, Calif.

[21] Appl. No.: 524,262

[22] Filed: Aug. 18, 1983

[51] Int. Cl.[3] ..... E21D 20/00

[52] U.S. Cl. ..... 405/288; 405/259

[58] Field of Search ..... 405/259, 260, 261, 288, 405/290, 303; 175/219

[56] References Cited

U.S. PATENT DOCUMENTS

| | | | |
|---|---|---|---|
| 2,371,789 | 3/1945 | Batten | 405/290 |
| 4,091,628 | 5/1978 | Kelley | 405/290 |
| 4,297,057 | 10/1981 | O'Neil | 175/219 X |
| 4,423,986 | 1/1984 | Skogberg | 405/259 |

*Primary Examiner*—David H. Corbin
*Attorney, Agent, or Firm*—F. Lindsey Scott

[57] ABSTRACT

A method and apparatus for safely supporting a first end of a roof support member in position on a mine roof from a safe location while a second end of the roof support member is bolted in place by a roof bolting machine including a personnel shielding means. The method consists essentially of positioning a miner beneath the personnel shielding means so that the miner can use the apparatus for supporting the first end of the roof support member while the second end of the roof support member is bolted in place. The apparatus comprises an elongated support member, a fitting means positioned on a first end of the elongated support member for engaging a hole in the first end of the roof support member, and means for use in gripping the apparatus to support the first end of the roof support member.

9 Claims, 4 Drawing Figures

A
B
C
D
E
10
12
14
16
18
20
22
24
3
30
32
34
36
38
40
42
44
46
48

METHOD AND APPARATUS FOR INSTALLING A ROOF SUPPORT MEMBER IN A MINE

This invention relates to a method and apparatus for supporting an end of a roof support member while the other end of the roof support member is bolted in place by a roof bolting machine.

In various mining operations, particularly coal mining operations, it is common to use roof support members to strengthen or support the roof of mines. The use of such support members is particularly common in main tunnels or entryways. When a plurality of roof support members are used, as is commonly the case, the plurality of support members may be referred to as a mat spacer or the like. Such support members are typically bolted in place by the use of roof bolts. A variety of techniques are known for bolting roof support members to the roof of the mine so that the roof of the mine can be strengthened and supported. Such roof bolts typically extend a selected distance into the formation comprising the roof of the mine and commonly utilize expanding members which firmly anchor the bolts into the formations forming the roof of the mine. In recent years, roof support members have been bolted in place by the use of roof bolting machines. The use of such machines is well known to the art and the machines typically comprise a movable support vehicle which includes a extendable member adapted to position the roof bolt in place through the roof support member and into the formations above the roof of the mine. Such roof bolting machines are typically equipped with personnel shields which extend above the machine and outwardly for some distance on at least one side of the machine. Unfortunately, such machines are normally adapted to bolt only one or a few positions without relocation. It is thus necessary that one end of the roof support member be held in place during the time that the roof bolting machine is bolting the other end of the roof support member in place. In the past, miners have held one end of the roof support member in position while the roof bolting machine bolted the other end of the roof support member in place. As a result of the stresses applied to the mine roof during the bolting operation, the likelihood of roof collapse in the vicinity of the roof support member is increased and the miner holding the roof support is in some danger. In many instances, such roof collapses are sudden and difficult to escape if mine personnel are beneath the collapse area. As a result, a continuing search has been directed to the development of a safe method for supporting the unsupported end of a roof support member while the other end of the roof support member is bolted in place by a roof bolting machine.

It has now been found that a first end of a roof support member can safely be held in position while a second end of the roof support member is bolted in place by a roof bolting machine, including a personnel shielding means, by an apparatus which comprises: (a) an elongated support member; (b) a fitting means positioned on a first end of the elongated support member, the fitting means including a fitting member adapted to slideably engage a hole in the first end of the roof support member; (c) a first handle means positioned on the second end of the elongated support member; and (d) a second handle means positioned at a distance along the elongated support member from the second end of the elongated member so that the fitting means can be held in engagement with a hole in the first end of the roof support member by an operator beneath the personnel shielding means.

A method for safely supporting a first end of a roof support member in position while a second end of the roof support member is bolted in position by a roof bolting machine is also disclosed.

In the description of the Figures, the same numbers will be used throughout to refer to the same or similar elements.

Figures 1, 2, 3, 4:
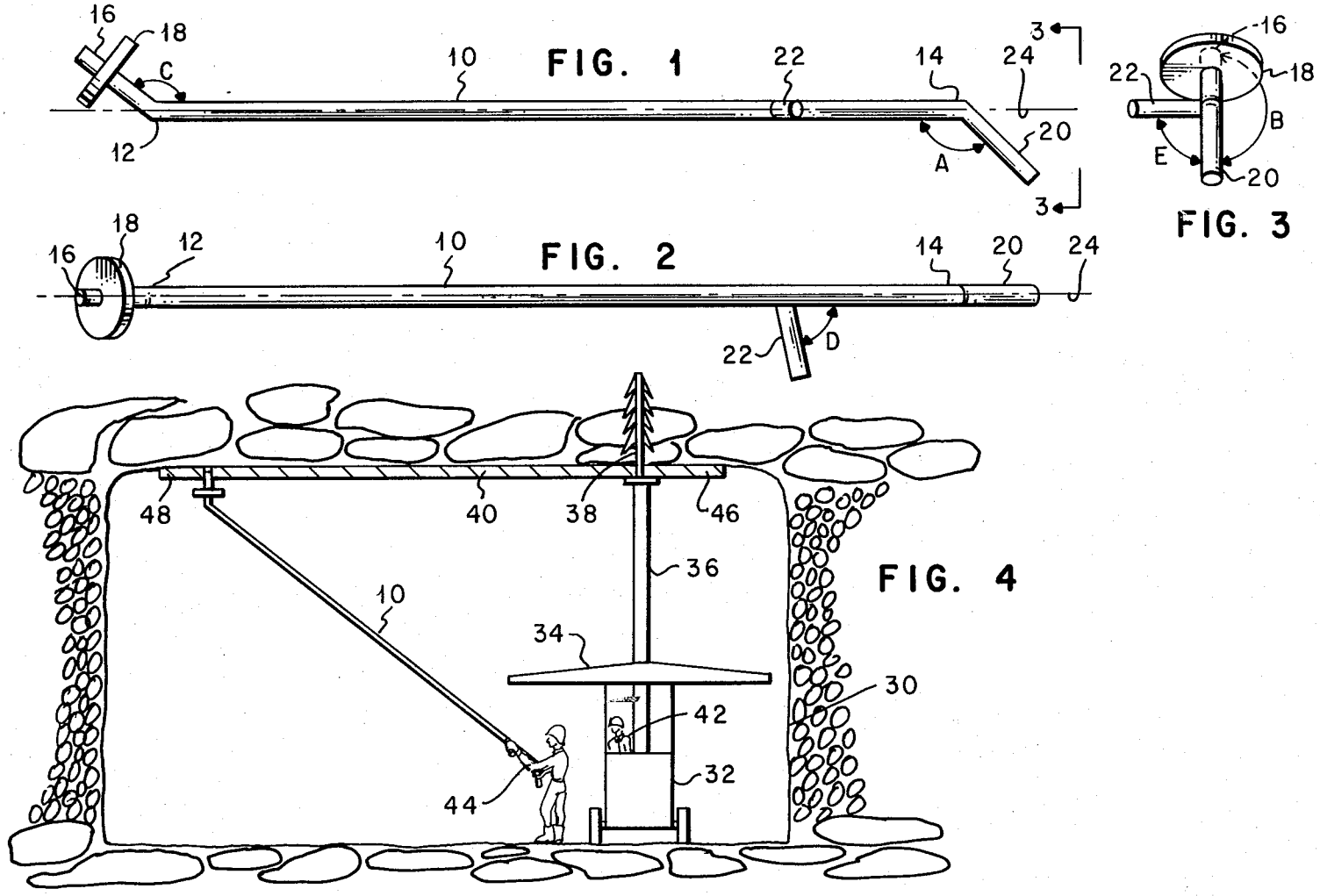
FIG. 1 is a schematic diagram of an embodiment of the apparatus of the present invention.
FIG. 2 is a top view of the apparatus shown in FIG. 1.
FIG. 3 is an end view of the apparatus shown in FIG. 1.
FIG. 4 is a schematic diagram of an embodiment of the present invention in use in a mine opening.

In FIG. 1, an embodiment of the apparatus of the present invention is shown. The apparatus shown in FIG. 1 comprises an elongated support member 10 having positioned on its first end 12 a fitting 16. A collar 18 is positioned on fitting 16 so that fitting 16 extends a predetermined distance through collar 18. A first handle 20 is positioned on a second end 14 of member 10. First handle 20 is positioned at an angle A of about 90° to about 150° from a longitudinal axis 24 of member 10. First handle 20 is also positioned at an angle B of about 150° to about 210° (shown in FIG. 3) from fitting 16. First handle 20 may have various materials positioned thereon to facilitate gripping first handle 20. Fitting 16 is positioned at an angle C of about 45° to about 75° from longitudinal axis 24 of member 10. Fitting 16 is desirably sized to slideably engage a hole such as a bolt hole in a roof support member. Collar 18 is desirably sized and positioned to prevent the penetration of fitting 16 into the roof support member hole further than necessary to support the roof member in position. In particular, it is undesirable that fitting 16 penetrate the hole in the roof support member to a distance sufficient that it is not readily removed in the event of roof collapse, normal disengagement and the like. Accordingly, fitting 16 should be of a size such that it readily enters the selected hole in the roof support member and collar 18 should be positioned a suitable distance from the end of fitting 16 so that the penetration of fitting 16 into the hole in the roof support member is limited. The apparatus also includes a second handle 22 positioned at a predetermined distance towards first end 12 of member 10 from first handle 20. Normally, second handle 20 is positioned from about 20 to about 30 inches from second end 14 of member 10. Member 10 is desirably a tubular member since tubular members provide greater strength relative to their weight than solid members and the like. Member 10 can be of a variety of shapes, although it is believed that usually round tubular members will be preferred.

FIG. 2 is a top view of the apparatus shown in FIG. 1. In FIG. 2, fitting 16 is shown as a smaller diameter member than tubular support member 10. Second handle 22 as shown in FIG. 2, is desirably at an angle D of about 45° to about 95° from longitudinal axis 24 of member 10.

FIG. 3 is an end view taken from second end 14 of member 10 as shown in FIG. 1. As shown in FIG. 3, second handle 22 is desirably at an angle E of about 75° to about 105° from first handle 20.

In FIG. 4, a mine opening 30 is shown with a roof support member 40 positioned along its roof. A roof bolter 32 is in position to bolt a roof support member 40 in position. Roof bolter 32 includes a personnel shield 34 and a bolter arm 36 which is adapted to position a bolt 38 through roof support member 40 and into the formations above the mine roof. A roof bolter operator 42 is normally required for the operation of roof bolter 32 and is normally positioned beneath personnel shield 34. By the use of the apparatus of the present invention, a miner 44 is able to stand beneath shield 34 and use the apparatus of the present invention to support a first end 48 of roof support member 40 in position while roof bolter 32 bolts a second end 46 of roof support member 40 in position.

The use of the apparatus of the present invention enables mine personnel to be positioned beneath the personnel shield normally carried on a roof bolting machine while holding the remote end of the roof support member in position during the bolting operation by the roof bolting machine. Clearly, rockfalls, roof collapses and the like which are more likely during the roof bolting machine activities are less likely to injure mine personnel when such personnel can be positioned beneath a personnel shield. Since the installation of roof support members in mines is a common occurrence and occurs many times each day in many mines, the risk to mine personnel is substantial when they are required to stand beneath the unsupported end of a roof support member while the other end of the roof support member is being subjected to bolting operations by a roof bolting machine. Such operations of necessity impose additional stresses and vibrations on the formations above the mine roof thereby resulting in an increased tendency for rockfalls, roof collapses and such to occur during the roof bolting operation. Accordingly, it is highly desirable that mine personnel be shielded during the performance of this necessary but dangerous operation. By the use of the apparatus of the present invention, mine personnel can be located beneath the personnel shield of the roof bolting machine while still holding the unsupported end of the roof support member in position during the roof bolting operation.

The apparatus may be constructed of materials commonly used in the art for the fabrication of such tools. Most metals used for the fabrication of tools can be used to form the apparatus. As indicated previously, the handles may include gripping material or other aids to facilitate the gripping of the apparatus by mine personnel to hold the unsupported end of a roof support member in position.

In the use of the apparatus, the unsupported end of a roof support member is supported by mine personnel who are located beneath the personnel shield of the roof bolting machine. After the roof bolting has been accomplished, the unsupported end of the roof support member can be held in position using the apparatus until the roof bolting machine can be moved to a location beneath the unsupported end so that the bolting operation can be completed. Obviously, more than one miner can be engaged in holding the unsupported ends of roof support members in position since a roof bolting machine may be utilized to bolt a plurality of roof support members to the roof before moving to the other side of the mine opening to bolt the opposite ends of the roof support members or the like. Obviously, a multitude of operating sequences are possible. In all such sequences, however, benefits are accomplished by having the miner supporting the unsupported end of the roof support member positioned beneath the shield of the roof bolting machine during the roof bolting operation.

While roof bolting is used commonly in coal mining operations, it is recognized that roof supports and roof bolting are also used in other mining operations and the use of the present invention is equally applicable to such mining operations.

Having thus described the present invention by reference to certain of its preferred embodiments, it is pointed out that the embodiments described are illustrative rather than limiting in nature and that many variations and modifications are possible within the scope of the present invention. Many such variations and modifications may be considered obvious and desirable to those skilled in the art based upon the foregoing description of preferred embodiments.

Having thus described the invention, I claim:

1. An apparatus for supporting a first end of a roof support member in position on a mine roof from a safe location while a second end of said roof support member is bolted to the mine roof by a bolting machine including a personnel shielding means, said apparatus comprising:

(a) an elongated support member;

(b) a fitting means positioned on a first end of said elongated support member, said fitting means including a fitting member adapted to slideably engage a hole in said first end of said roof support member;

(c) a first handle means positioned on a second end of said elongated support member; and, (d) a second handle means positioned at a distance along said elongated support member from said second end of said elongated support member so that said fitting member can be held in engagement with a hole in said first end of said roof support member by an operator beneath said personnel shielding means.

2. The apparatus of claim 1 wherein said elongated support member is a tubular member.

3. The apparatus of claim 2 wherein said fitting member is positioned at an angle of from about 45° to about 75° from the longitudinal axis of said tubular member.

4. The apparatus of claim 3 wherein a collar member is positioned on said fitting member to limit the penetration of said fitting member into said hole.

5. The apparatus of claim 4 wherein said first handle is positioned on said second end of said tubular member and at an angle from about 90° to about 150° from said longitudinal axis of said tubular member and at a rotational angle relative to said longitudinal axis from about 150° to about 210° from said fitting member.

6. The apparatus of claim 4 wherein said second handle is positioned from about 20 to about 30 inches along the length of said tubular member from said second end of said tubular member.

7. The apparatus of claim 6 wherein said second handle is positioned at a rotational angle relative to said longitudinal axis from about 75° to about 105° from said first handle.

8. A method for safely supporting a first end of a roof support member in position on a mine roof from a safe location while a second end of said roof support member is bolted in place by a roof bolting machine including a personnel shielding means, said method consisting of:

(a) positioning a miner generally beneath said personnel shielding means so that said miner can position an apparatus for supporting said first end of said roof support member in engagement with a hole in said first end of said roof support member, said apparatus comprising an elongated support member; a fitting means positioned on a first end of said elongated support member for engaging said hole and handle means positioned on said second end of said elongated support member for use by said miner in gripping said apparatus;

(b) supporting said first end of said roof support member by said miner holding said first end of said roof support member in position;

(c) bolting said second end of said roof support member in place; and thereafter (d) bolting said first end of said roof support member in place.

9. The method of claim 8 wherein a plurality of roof support members are bolted in place.

* * * * *